US011946703B2

(12) United States Patent
Masliah et al.

(10) Patent No.: US 11,946,703 B2
(45) Date of Patent: Apr. 2, 2024

(54) HEAT EXCHANGER COMPRISING AT LEAST ONE PARTICLE FILTER IN ONE OR MORE OF ITS PASSAGES

(71) Applicant: L'Air Liquide Société Anonyme pour l'Etude et l'Exploitation des Procédés Georges Claude, Paris (FR)

(72) Inventors: Eric Masliah, Brunoy (FR); Arnaud Gueguen, Beauchamp (FR); Gilles Lebain, Thiais (FR); Ludovic Amant, Vaires sur Marne (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 17/742,789

(22) Filed: May 12, 2022

(65) Prior Publication Data

US 2022/0364803 A1 Nov. 17, 2022

(30) Foreign Application Priority Data

May 12, 2021 (FR) ..... 2105021

(51) Int. Cl.
*F28F 19/01* (2006.01)
*F28D 9/00* (2006.01)
(Continued)

(52) U.S. Cl.
CPC ..... *F28F 19/01* (2013.01); *F28D 9/005* (2013.01); *F28F 3/044* (2013.01); *F28F 3/048* (2013.01); *F28F 3/086* (2013.01)

(58) Field of Classification Search
CPC ..... F28D 9/0068; F28F 19/01
See application file for complete search history.

(56) References Cited

U.S. PATENT DOCUMENTS 9,127,896 B1 * 9/2015 Nehlen, III ..... B01D 35/18
2009/0159249 A1 6/2009 Pustelnik et al.
(Continued)

FOREIGN PATENT DOCUMENTS

CN 109595958 4/2019
EP 0 460 872 5/1991
(Continued)

OTHER PUBLICATIONS

French Search Report for corresponding FR 2105021, dated Dec. 12, 2021.

*Primary Examiner* — Devon Russell
(74) *Attorney, Agent, or Firm* — Elwood L. Haynes

(57) ABSTRACT

A heat exchanger having a stack of multiple plates which are parallel to one another and to a longitudinal direction, and stacked spaced apart from one another so as to define, between one another, a first series of passages for the flow of at least a first fluid in an overall flow direction parallel to the longitudinal direction, each passage being delimited by closure bars disposed between the plates. A filtering device is arranged in at least one passage of the first series, the filtering device extending for the one part between two adjacent plates defining the passage and for the other part between two of the closure bars delimiting the passage, the filtering device having a metal sheet material chosen from among a metal fabric, a nonwoven of metal fibres, a sintered metal powder or sintered metal fibres, a metal foam, or a microperforated plate.

14 Claims, 7 Drawing Sheets

(51) Int. Cl.
*F28F 3/04* (2006.01)
*F28F 3/08* (2006.01)

(56) References Cited

U.S. PATENT DOCUMENTS

| | | | | |
|---|---|---|---|---|
| 2018/0292143 | A1* | 10/2018 | Aigner | B23K 1/008 |
| 2021/0041190 | A1 | 2/2021 | Noishiki | |
| 2022/0268537 | A1* | 8/2022 | Livni | F28F 19/01 |
| 2022/0341676 | A1* | 10/2022 | Myklebust | F28F 9/0075 |
| 2023/0070696 | A1* | 3/2023 | Denoual | F28F 19/002 |

FOREIGN PATENT DOCUMENTS

| | | | |
|---|---|---|---|
| FR | 3 037 633 | | 12/2016 |
| JP | 2014098527 | A * | 5/2014 |
| JP | 2015014388 | A * | 1/2015 |

* cited by examiner

HEAT EXCHANGER COMPRISING AT LEAST ONE PARTICLE FILTER IN ONE OR MORE OF ITS PASSAGES

CROSS REFERENCE TO RELATED APPLICATIONS

This application claims the benefit of priority under 35 U.S.C. § 119 (a) and (b) to French Patent Application No. 2105021, filed May 12, 2021, the entire contents of which are incorporated herein by reference.

SUMMARY

The present invention relates to a heat exchanger, in particular a heat exchanger of the brazed fin and plate type, comprising at least one filter for limiting the introduction of undesirable particles into the body of the heat exchanger or for retaining particles fulfilling a specific function inside said body of the heat exchanger.

The present invention applies in particular in the field of hydrogen liquefaction. In particular, the invention can apply to a catalytic heat exchanger in which a flow of gaseous hydrogen is cooled, or even liquefied entirely or in part, by the exchange of heat with a flow of refrigerant fluid, and also to the cooling and/or liquefying method implementing said heat exchanger.

The present invention also applies to the cryogenic separation of gases, in particular the separation of air by cryogenic distillation. In particular, the present invention can apply to a heat exchanger that vaporizes a flow of liquid, for example liquid oxygen, nitrogen and/or argon, by the exchange of heat with a gaseous flow, for example air or nitrogen.

The present invention can also apply to a heat exchanger that vaporizes at least one flow of liquid-gas mixture, for example a mixture of hydrocarbons, by the exchange of heat with at least one other fluid to be liquefied, such as natural gas.

A technology that is commonly used for heat exchangers is that of brazed plate heat exchangers, which make it possible to obtain highly compact components that afford a large heat-exchange surface area and low pressure losses. These heat exchangers comprise one or more exchange bodies formed by a set of parallel plates between which spacer elements, such as corrugated structures or corrugations, which form fin heat-exchange structures, may be inserted. The stacked plates form, between one another, a stack of flat passages for different fluids to be brought into a heat-exchange relationship. The exchangers comprise fluid manifolds equipped with inlet and outlet pipes for introducing fluids into the heat-exchange body and for discharging fluids from the heat-exchange body.

Certain heat exchangers may require the installation of a fluid filtration device in order to limit or even avoid the introduction into the body of the heat exchanger of solid particles which adversely affect the thermal and hydraulic performance of the heat exchanger.

In other heat exchangers, it is necessary by contrast to retain particles inside the body of the heat exchanger. These particles may be arranged inside passages of the heat-exchange body so as to perform various functions there. In catalytic heat exchangers in particular, the particles are formed by a catalyst material that produces a chemical reaction with the fluid circulating in the passages.

Known in particular are catalytic heat exchangers which are intended for the liquefaction of hydrogen, in which the ortho-hydrogen molecules are converted into para-hydrogen molecules during the liquefaction by virtue of a suitable catalyst. In these heat exchangers, the inlet and outlet manifolds for introducing and discharging hydrogen are generally formed by domes covering the fluid inlet and outlet openings of the body of the heat exchanger over all of the sides of the body on which the domes are disposed. In order to limit the movement of catalyst particles in the passages of the heat exchanger, the internal volume of the inlet and outlet manifolds is also filled with catalyst, thereby significantly increasing the amount of catalyst to be used.

The body and the manifolds of the heat exchanger are filled after these elements have been brazed to one another. A heat exchanger equipped with such a filling device is partially depicted schematically in FIG. 1. The catalyst is distributed through one or more vertical pipes 100 located at the top of the heat exchanger and connected to the internal volume of a manifold. Filling takes place by gravity flow of the catalyst particles through the vertical pipes 100 by means of specific distribution nozzles. The manifold is also equipped with a lateral pipe 200 in which cylindrical filtration cartridges are inserted before filling with the catalyst. These cartridges are made of a porous material configured to allow the fluid to enter the manifolds but to block the catalyst particles. A fluid inlet duct 300 is connected to the lateral pipe such that the fluid is distributed in the heat exchanger via the filtration cartridge.

This solution leads to a complex architecture requiring the attachment of numerous ducts to the heat exchanger manifolds. In addition to the complexity of the manufacture and use of filtration cartridges, this solution needlessly increases the volume of catalyst used since the manifolds are also filled with it. As a matter of fact, the catalysts are specific and expensive materials.

Moreover, the use of domes limits the width of the heat exchanger that must not be exceeded. This is because, with regard to the operating pressure of certain heat exchangers, in particular heat exchangers of the catalytic heat exchanger type, which can be high, in general between 25 bar and 60 bar, wide heat exchanger sections need to have domes that are all the more bulky and formed by metal sheets of greater thickness. Because of the difficulties in fixing such domes on the heat exchanger body, it is difficult to conceive designing and manufacturing the heat exchanger on an industrial scale.

Moreover, the introduction of catalyst into the heat-exchange body is complex and requires specific tooling. The homogeneity of the distribution of the catalyst particles between the various passages of the heat-exchange body is difficult to control.

SUMMARY

The object of the present invention is in particular to solve all or some of the problems mentioned above by providing a heat exchanger equipped with a filtration device, the design and implementation of which are simpler than in the prior art, and which allows, in particular when the heat exchanger is intended to implement catalytic reactions, the catalyst to be retained in the passages and the passages to be filled in a simpler and better controlled manner, and also a reduced amount of catalyst that is to be used, and which also makes it possible to simplify the design and the fixing of all or some of the fluid inlet and outlet manifolds.

A solution according to the invention is then a heat exchanger comprising a stack of multiple plates which are parallel to one another and to a longitudinal direction, said plates being stacked spaced apart from one another so as to define, between one another, a first series of passages for the flow of at least a first fluid in an overall flow direction parallel to the longitudinal direction, each passage being delimited by closure bars disposed between the plates, characterized in that a filtering device is arranged in at least one passage of the first series, said filtering device extending for the one part between two adjacent plates defining said passage and for the other part between two of the closure bars delimiting said passage, said filtering device comprising a metal sheet material chosen from among a metal fabric, a nonwoven of metal fibres, a sintered metal powder or sintered metal fibres, a metal foam, or a microperforated plate.

Depending on the case, the heat exchanger according to the invention may comprise one or more of the features listed below.

The heat exchanger comprises at least a first inlet or outlet manifold configured for introducing the first fluid into or collecting the first fluid from the first passages, a distribution structure and a heat-exchange structure being arranged consecutively from the first inlet or outlet manifold in said at least one passage, the filtering device being arranged between the distribution structure and the heat-exchange structure.

The heat exchanger comprises at least a first inlet or outlet manifold configured for introducing the first fluid into or collecting the first fluid from the first passages, a distribution structure and a heat-exchange structure being arranged consecutively from the first inlet or outlet manifold in said at least one passage, the filtering device being arranged between the distribution structure and the first inlet or outlet manifold.

Said at least one passage comprises an inlet or outlet opening leading into said first inlet or outlet manifold, said at least one passage having a width measured parallel to a lateral direction which is perpendicular to the longitudinal direction and orthogonal to the plates, the width of the inlet or outlet opening, measured parallel to the lateral direction, constituting between 10% and 70%, preferably between 20% and 50%, of the width of the passage.

The filtering device comprises two ends, each of which is arranged in a respective recess in a closure bar.

Said recess has a maximum width measured parallel to the longitudinal direction and comprises a first portion formed over a maximum height corresponding to the height of the bar, said heights being measured parallel to a stacking direction perpendicular to the longitudinal and lateral directions, said first portion being formed over a minimum width less than the maximum width, said recess moreover comprising at least one second portion formed over a minimum height less than the maximum height and extending over the maximum width.

The filtering device comprises at least one front face arranged perpendicularly to the overall flow direction of the first fluid, said front face being connected to at least one lateral face arranged parallel to a plate.

The filtering device has a total width, measured parallel to the longitudinal direction, of between 2 and 10 mm, preferably between 3 and 7 mm.

The metal sheet material has a thickness of 0.20 to 0.75 mm, preferably of between 0.3 and 0.5 mm.

The metal sheet material has an open surface density ranging from 15% to 35% or a volume density of pores ranging from 75% to 98%.

The metal sheet material is a woven fabric of metal threads, said threads having a diameter of 0.10 to 0.30 mm, preferably of 0.10 to 0.25 mm.

The metal sheet material comprises at least one series of first metal threads and a series of second threads interlaced so as to form meshes, each mesh being delimited between two consecutive first threads and two consecutive second threads, the meshes having an opening size of 0.07 mm to 0.15 mm.

The metal sheet material is a microperforated plate having a plurality of orifices the size of which, measured in a plane parallel to the plates, is at most between 0.07 mm and 0.15 mm.

The heat exchanger is an exchanger-reactor configured to implement catalytic reactions between the first fluid and at least one catalyst material, at least some of the passages of the first series containing particles of said at least one catalyst material.

The catalyst material comprises particles having an equivalent diameter ranging from a minimum diameter to a maximum diameter, the metal sheet material being a woven fabric of metal threads with a mesh opening size ranging from 10% to 85% of said minimum diameter of the particles.

The heat exchanger is configured for the liquefaction of hydrogen as first fluid, the catalyst material being configured for the conversion of ortho-hydrogen into para-hydrogen, in particular the catalyst material is iron oxide.

The invention also relates to a method for cooling and/or liquefaction of at least a portion of a stream of gaseous hydrogen against a stream of refrigerant fluid, said streams being introduced respectively into the first passages and the second passages of a heat exchanger according to the invention.

In particular, the method according to the invention implements the conversion of at least some of the ortho-hydrogen molecules of the stream of gaseous hydrogen into para-hydrogen molecules by means of particles of at least one catalyst material.

In particular, the stream of gaseous hydrogen has a pressure ranging from 20 to 80 bar, preferably from 25 to 40 bar.

BRIEF DESCRIPTION OF THE DRAWINGS

The invention will now be understood better by virtue of the following description, which is given by way of illustrative and non-limiting example and with reference to the appended figures.

DETAILED DESCRIPTION OF PREFERRED EMBODIMENTS

Figure 1:
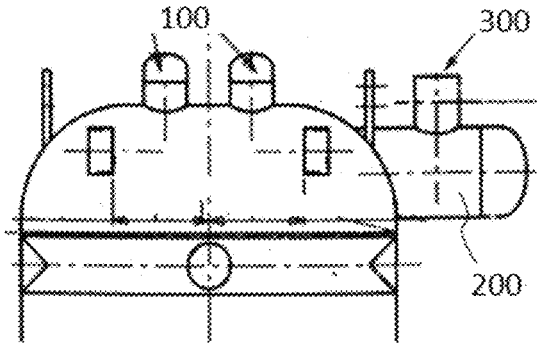
FIG. 1 is a partial view of a heat exchanger with a filtration device according to the prior art.
Figure 2:
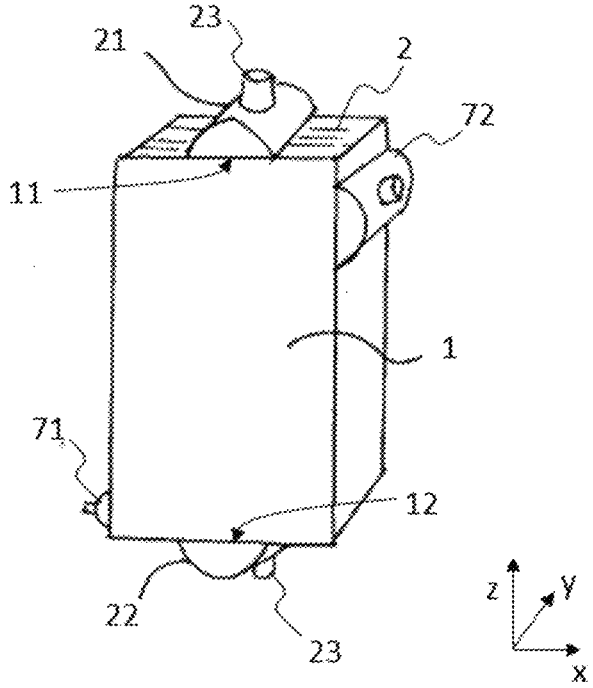
FIG. 2 is a three-dimensional view of a heat exchanger according to another embodiment of the invention.
Figure 3:
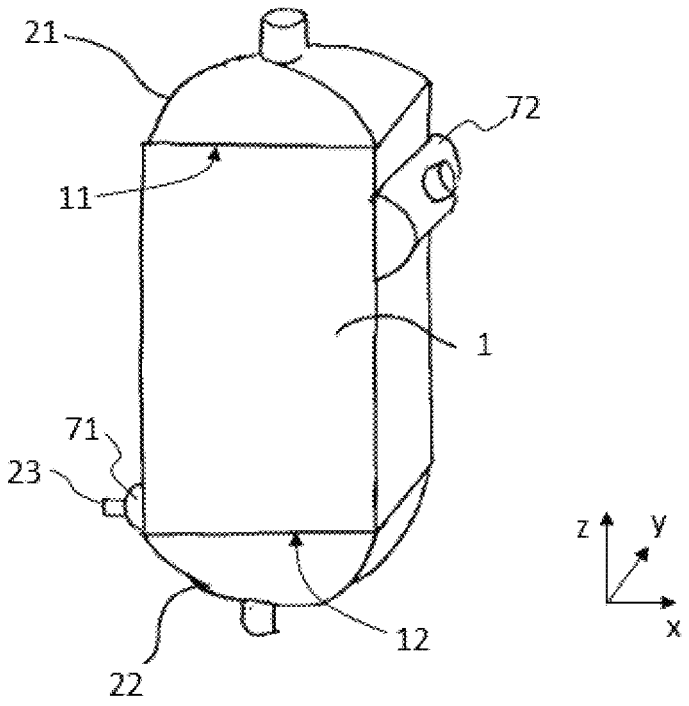
FIG. 3 is a three-dimensional view of a heat exchanger according to another embodiment of the invention.

With reference to FIG. 2 or FIG. 3, a heat exchanger according to one embodiment of the invention is of the brazed fin and plate type. The elements constituting the heat exchanger are preferably made of aluminium or an aluminium alloy. The heat exchanger comprises a heat-exchange body 1 formed by a stack of plates 2. The plates 2 extend in two dimensions, length and width, in the longitudinal direction z and the lateral direction x, respectively. The plates 2 are disposed one on top of another, parallel to one another, and spaced apart from one another.

They thus form, between one another, at least a first series of passages 10 and a second series of passages 20, the passages 10 of the first series being provided for the flow of a first fluid and the passages of the second series being provided for the flow of at least a second fluid to be brought into an indirect heat-exchange relationship with the first fluid via the plates 2. The lateral direction x is perpendicular to the longitudinal direction z and parallel to the plates 2. The fluids flow preferably along the length of the heat exchanger and overall parallel to the longitudinal direction z, the length being great in comparison with the width of the heat exchanger.

The spacing between two successive plates 2, corresponding to the height of a passage that is measured in the stacking direction y of the plates 2, is small in comparison with the length and the width of each successive plate. The stacking direction y is orthogonal to the plates. The passages 10 may be entirely or in part arranged in alternation with or adjacent to all or some of the passages 20 of the second series. Preferably, at least some of the passages 10, 20 comprise fin heat-exchange structures, for example corrugated structures, which extend along the width and the length of the passages of the heat exchanger, parallel to the plates 2.

In a particular embodiment of the invention, the passages 10 of the first series and the passages 20 of the second series are provided respectively for the flow of hydrogen ($H_2$) as first fluid. The second fluid may be hydrogen ($H_2$), helium (He) or nitrogen ($N_2$). Preferably, the second fluid is liquid hydrogen or liquid helium, this making it possible to increase the thermal efficiency. In particular, the second fluid may be hydrogen which is already cooled, in particular entirely or partially liquefied, coming from another heat exchanger of the same type as that which is the subject of the invention. When the heat exchanger is used for the cooling and/or liquefaction of hydrogen, the hydrogen as first fluid is the calorigenic fluid and the second fluid is the refrigerant fluid. It will be noted that other fluid compositions may be used for the refrigerant fluid.

Preferably, each passage 10, 20 has a flat and parallelepipedal shape. The heat exchanger comprises closure bars 6 disposed between the plates 2, at the periphery of the passages. These bars 6 provide the spacing between the plates 2 and ensure the sealing of the passages.

In a manner known per se, the heat exchanger comprises distribution and discharge means 21, 22, 71, 72, referred to as manifolds or header tanks, which means are joined to sides of the stack and are configured to distribute the fluids selectively into the passages 10, 20 and to discharge said fluids from said passages 10, 20. Each manifold has peripheral walls delimiting an internal volume, an open end located on the side of the heat-exchange body, and a pipe 23 designed to feed fluid into or discharge fluid from the internal volume.

The closure bars 6 do not fully close off the passages but leave openings free on the sides of the body 1 for the corresponding fluids in the passages to enter or leave. The inlet openings 11 for introducing each of the fluids circulating in the heat exchanger are disposed in a coincident manner one above the other. The outlet openings for discharging each of the fluids circulating in the heat exchanger are disposed in a coincident manner one above the other. The inlet openings 11 in the passages 10 of the first series are joined fluidically in a first inlet manifold 21. The outlet openings 12 in the passages 10 of the first series are joined fluidically in a first outlet manifold 22.

The inlet openings in the second passages 20 are joined fluidically in a second inlet manifold 71. The outlet openings in the second passages 20 located one above the other are joined fluidically in a second outlet manifold 72.

It is specified that the features of the invention given in the present description in connection with the passages of the first series can be applied to other passages and that a filtration solution according to the invention is conceivable for all or some of the fluids circulating in the heat exchanger.

According to a possibility illustrated in FIG. 2, the inlet and outlet manifold(s) 21, 22, 71, 72 are in the form of semi-tubular heads, i.e. are semi-cylindrical, and only partially cover the sides of the body on which they are disposed. Distribution corrugations are arranged between the successive plates 2, which distribution corrugations are in the form of corrugated metal sheets which extend from the inlet or outlet openings and provide uniform distribution and guidance of the fluids over the entire width of the passages 10, 20 as far as the heat-exchange zone of the passages.

Preferably, at least one part of the manifolds 21, 22, 71, 72 extends, in the stacking direction y, over the entire height of the body 1 and, in the lateral direction x, over part of the width of the body 1, facing the inlet and outlet openings in the passages 10.

According to another possibility illustrated in FIG. 3, the inlet and/or outlet manifold(s) 21, 22, 71, 72 are in the form of domes and fully cover the sides of the body on which they are disposed.

It will be noted that a heat exchanger according to the invention may comprise both manifolds in the form of domes and manifolds in the form of heads, in particular the first inlet manifold 21 may be in the form of a dome and the first outlet manifold 22 in the form of a head.

In the embodiments illustrated, the first inlet manifold 21 for the first fluid and the second outlet manifold 72 are located at one and the same end of the heat exchanger, the first and second fluids thus circulating in countercurrent in the passages of the heat exchanger. Preferably, the longitudinal direction is vertical when the heat exchanger is in operation. The first inlet manifold 21 for the first fluid is located at an upper end of the heat exchanger, and the first outlet manifold 22 for the first fluid is located at a lower end of the heat exchanger. The first fluid flows overall vertically and downwards, that is to say counter to the direction z in FIG. 2. Other directions of flow of the fluids are of course conceivable without departing from the scope of the present invention.

Figure 4:
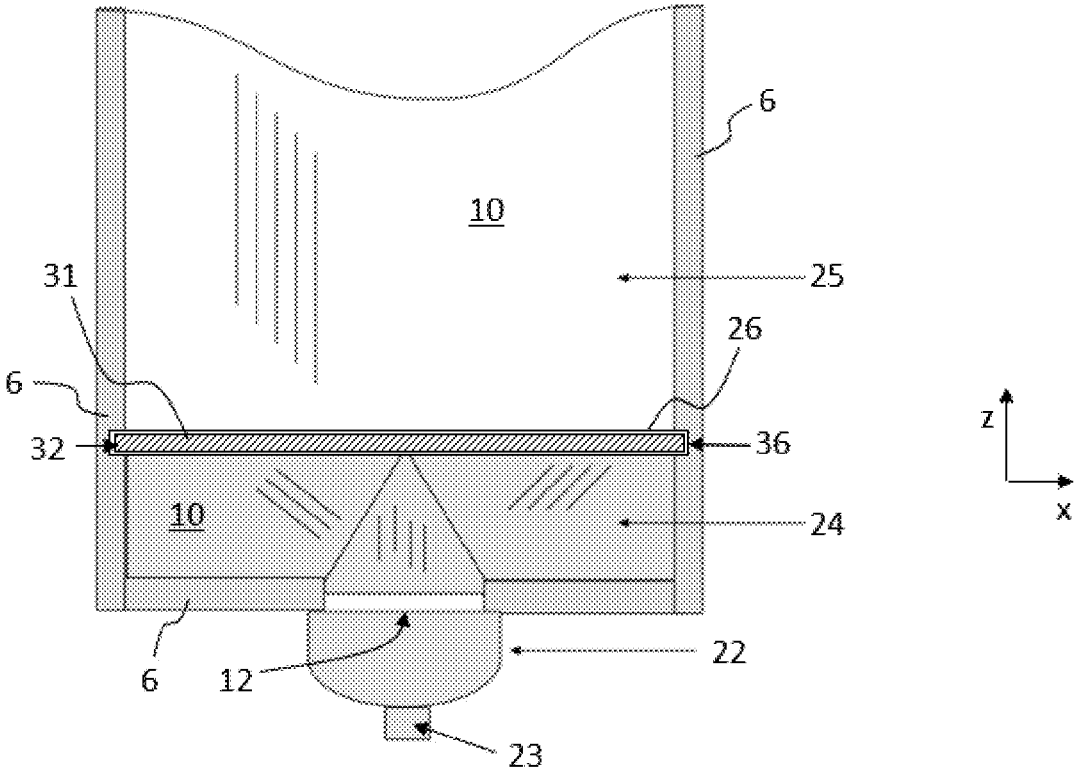
FIG. 4 shows a partial view in longitudinal section of a passage of a heat exchanger according to one embodiment of the invention.
Figure 5:
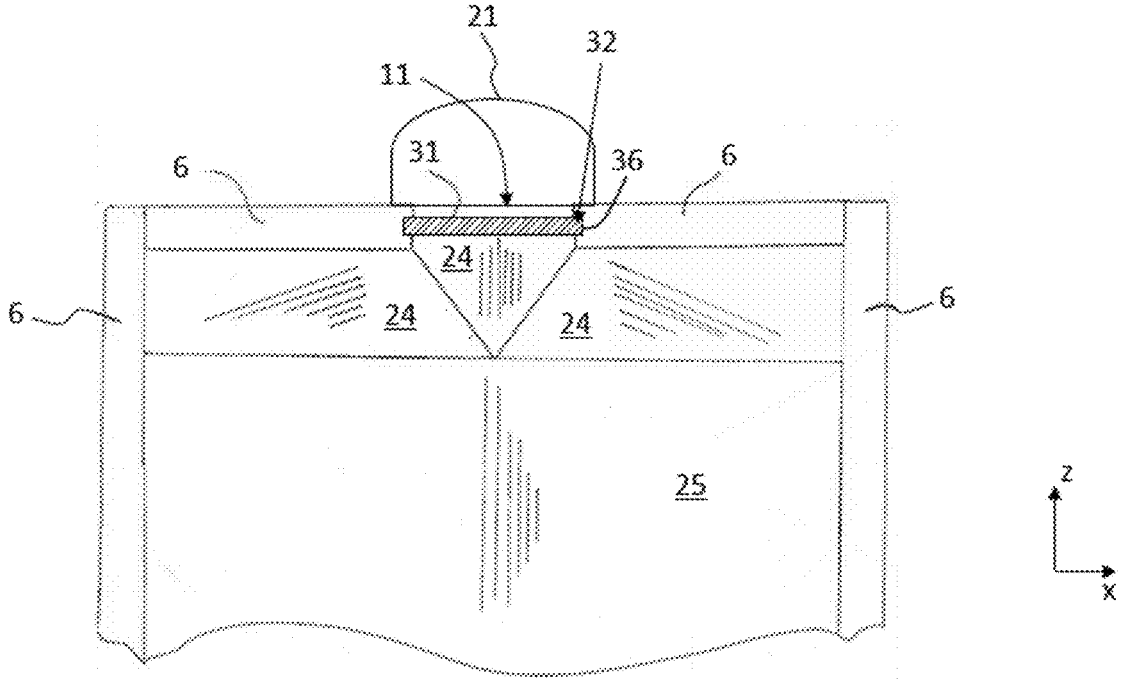
FIG. 5 shows a partial view in longitudinal section of a passage of a heat exchanger according to another embodiment of the invention.

As can be seen in FIG. 4 or FIG. 5, which show views in longitudinal section of a passage 10 of the first series, according to the invention a filtering device 31 is arranged in at least one passage 10 of the first series. The filtering device 31 extends for the one part between two adjacent plates 2 and for the other part between two of the closure bars 6 delimiting said passage 10. The filtering device 31 comprises a metallic sheet material 30 chosen from among a metal fabric, a nonwoven of metal fibres, a sintered metal powder or sintered metal fibres, a metal foam, or a microperforated plate.

The term "metal fabric" is understood to mean a manufactured product obtained by weaving metal threads, that is to say interlacing threads so as to obtain a metal woven fabric, i.e. a metal fabric. It will be noted that the term "metal fabric" can also cover a manufactured product obtained by welding metal threads, i.e. a welded fabric formed by intersecting threads which are spot-welded at the intersection point.

The term "nonwoven", or unwoven fabric, is understood to mean a manufactured product formed by fibres disposed in a sheet and oriented randomly or directionally, and connected to one another by mechanical, chemical or thermal methods or by a combination of these methods, excluding weaving. In particular, the nonwoven may be formed by fibres connected by friction, cohesion or adhesion.

The term "sintered" denotes a material obtained by sintering metal fibres or powder, that is to say by heating a powder or fibres without causing them to melt. Under the effect of the heat, the grains or fibres are welded to one another, resulting in the cohesion of the material.

The term "foam" denotes an alveolar structure made of a metal and containing a significant volume of pores.

A microperforated plate denotes a plate comprising microperforations, that is to say through-orifices of micrometre size, that is to say less than a millimetre.

The use of a metal fabric, a nonwoven of metal fibres, a sintered metal, a metal foam or a microperforated plate results in a material which has openings, or open pores, that can be dimensioned so as to allow the flow of fluid while still preventing the passage of solid particles which are to be retained in the heat-exchange body or the introduction of which into said body is to be avoided. These materials afford a good compromise between fluid permeability, filtration efficiency, by virtue of the small opening dimensions that can be obtained, and stiffness of the filter.

By virtue of its sheet structure, the filtering device can be easily shaped, in particular by bending or moulding in a press, so as to be able to be positioned inside a heat exchanger passage, transversely thereto, in order to provide the particle blocking function there. The filtering device can thus be positioned close to the heat-exchange or distribution structures that are arranged in the passage. In the case of catalytic heat exchangers, this makes it possible to significantly reduce the volume of catalyst used, since the manifolds no longer have to be filled with catalyst.

It is likewise conceivable to provide distribution zones without catalyst within the passages, this making it possible to use semi-cylindrical manifolds. The semi-cylindrical heads can be manufactured more simply than the domes and can be joined to the heat exchanger body in a shorter amount of time and in a less complicated manner. The use of heads also makes it possible to increase the section of the heat exchanger body and therefore to reduce the number of heat exchanger bodies to be implemented in one and the same cold box.

The use of a filtering device is particularly advantageous in a heat-exchange method in which at least the first fluid has a relatively high pressure, that is to say 20 to 80 bar, in particular 25 to 40 bar. This is because these pressures require an increase in the thickness of the material used to form the fluid manifolds. Specifically, in order to fix the domes to the body of the heat exchanger by welding, the increased thickness of the metal sheets of these domes requires increasing the thickness of the closure bars of the heat exchanger. This industrial and economic constraint therefore limits the increase in the section of the heat exchangers. For manifolds in the form of a dome, this would limit their size, and therefore the dimensions of the body of the heat exchanger. The distribution zone formed by virtue of the filtering device makes it possible, with a reasonable thickness, to increase the section of the heat exchangers and therefore to limit the number of heat-exchange bodies required.

The manufacture and implementation of these filters are also simplified in relation to those of the filtration cartridges of the prior art. The filtering devices may be inserted into the passages while the plates are being stacked, before the stack is brazed. Once the filters have been assembled in the stack, it can be arranged vertically so as to be filled with catalyst by gravity. The filtering devices placed at the bottom of the stack retain the catalyst in the passages. This makes it possible to fill the passages in a more homogeneous way through the height of the stack.

The invention also makes it possible to avoid welding filters on the manifolds or the body, any welding operation on the body presenting the risk of overheating and cohesion of the brazed elements in the stack.

Preferably, a filtering device as described in the present application is positioned in multiple passages 10, or even all of the passages 10. Preferably, for all or some of the passages 10, a filtering device is provided at least on the side where the outlet manifold 22 is, or even on each side of the passage 10, on the side where the inlet manifold 21 is and on the side where the outlet manifold 22 is.

According to one embodiment, a main part of the length of the passages 10 constitutes the actual heat-exchange zone, that is to say the zone in which the fluids exchange heat and/or react with a catalyst, if appropriate. The heat-exchange zone is preferably bordered on either side by distribution zones in which the fluids are conveyed from or to the inlet or outlet manifolds. These distribution and heat-exchange zones are advantageously fitted with structures 24, 25 which extend along the width and the length of the passage 10, parallel to the plates 2. The distribution structures 24 are configured to direct and ensure uniform collection and distribution of the fluids over the entire width of the heat-exchange zones, from the inlet manifolds or to the outlet manifolds.

The distribution and heat-exchange structures advantageously comprise corrugations or corrugated structures. These structures may be chosen from among the various types of corrugations usually implemented in heat exchangers of the brazed fin and plate type, such as straight corrugations, corrugations referred to as partially offset corrugations (of the "serrated" type), or herringbone corrugations. These corrugations may be perforated or not perforated. The structures may be formed in a single piece or by multiple juxtaposed sheets of corrugations.

According to an embodiment shown in FIG. 4, said at least one passage 10 comprises at least one distribution structure 24 and a heat-exchange structure 25 which are positioned consecutively from the first outlet manifold 22. It will be noted that the same arrangement may be provided on the side where the first inlet manifold 21 is. The filtering device 31 is arranged between the distribution structure 24 and the heat-exchange structure 25, preferably in a free space 26 formed between said structures. The free space 26 extends from a space without any distribution or heat-exchange structure in the passage 10.

This embodiment is particularly advantageous for use in a catalytic exchanger-reactor, since it makes it possible to provide, between the heat-exchange zones and manifolds, distribution zones without catalyst, the filtering device retaining the catalyst in the heat-exchange zone, at the location where it is used to react with the first fluid. This further reduces the amount of catalyst used in the heat exchanger passages. This also makes it possible to use inlet and/or outlet manifolds in the form of heads which only partially cover the faces of the stack, as illustrated in FIG. 2. The use of heads can be advantageous, in comparison with the use of domes covering the entirety of a stack face, since it reduces the bulk of the manifolds, makes it easier to join them to the body of the heat exchanger and reduces the duration of operations of welding the manifolds to the body.

Preferably, the filtering device 31 is arranged at some distance from the outlet opening 12 in the passage 10, or from the inlet opening 11 if said filtering device is arranged on the side where the inlet manifold 21 is, of between 10 and 50 cm.

Preferably, the filtering device 31 extends over a total width, measured parallel to the longitudinal direction z which may be equal or substantially equal to, preferably less than, the width of the free space, measured in the same way. Preferably, there is a relatively small clearance, or even no clearance or virtually no clearance, between the filtering device, the distribution structure 24 and the heat-exchange structure 25. In particular, there is a first clearance, corresponding to the distance between the filtering device 31 and the distribution structure 24 and/or to the distance separating the filtering device 31 from the heat-exchange structure 25, measured parallel to the longitudinal direction z. Preferably, the first clearance is between 0 and 3 mm, in particular between 0.5 and 3 mm. This avoids a possible passage of the particles around the filtering device. Moreover, the presence of a small clearance may compensate any deficiency in the rectilinear nature of the filtering device 31.

In the embodiment in FIG. 4, the filtering device extends between the two closure bars 6 which extend parallel to the longitudinal direction z and each delimit a longitudinal edge of the passage 10, that is to say an edge parallel to the longitudinal direction z. Preferably, the filtering device 31 has a length, measured parallel to the lateral direction x, which is equal to or greater than the width of the passage 10.

Advantageously, the length of the filtering device 31 is greater than the width of the passage 10, such that the two ends 32 engage in each of the closure bars 6. Preferably, each of these closure bars 6 comprises a recess 36 shaped to accommodate an end 32 of the filtering device 31.

According to another embodiment, an example of which is shown in FIG. 5, the heat exchanger according to the invention comprises a filtering device 31 arranged between the distribution structure 24 and the first inlet or outlet manifold 21, 22, preferably at the inlet or outlet openings 11, 12 in the passage 10.

The filtering device 31 is arranged so as to separate the internal volume of the manifold from that of the passage 10. This embodiment is suitable in particular for a heat exchanger the filter function of which is to avoid the introduction of particles as soon as they enter the heat exchanger. It makes it possible to use a filtering device having a length which is less than the width of the passage 10, this reducing the size of the device and facilitating its manufacture. It is enough that the filtering device 31 has a length at least equal to the width of the opening formed between the closure bars 6 delimiting the lateral edge of the passage on which the manifold is arranged. A lateral edge extends from an edge parallel to the lateral direction x.

The configuration in FIG. 4 is especially suitable in a catalytic heat exchanger having the filtering device arranged on the side where the outlet manifold 22 is so as to retain the catalyst. The configuration in FIG. 5 may be adapted to any heat exchanger in which the introduction of solid particles is to be blocked. It will be noted that these considerations do not at all rule out the other configurations which remain conceivable.

Preferably, the filtering device 31 is arranged between the two closure bars 6 which delimit the passage 10 at a lateral edge. According to one possibility, the filtering device 31 comprises two ends 32, each of which is arranged in a respective recess 36 in each closure bar 6.

As can be seen in FIG. 4 or FIG. 5, said at least one passage 10 comprises an inlet or outlet opening 11, 12 leading into said first inlet or outlet manifold 21, 22. The passage 10 and the openings 11, 12 each have widths measured parallel to the lateral direction x. Preferably, the width of the inlet or outlet opening 11, 12 is less than the width of the passage 10, in particular the width of the inlet or outlet opening 11, 12 constitutes between 10% and 70% of the width of the passage 10, preferably between 20% and 50%. This makes it possible to significantly reduce the width of the inlet or outlet manifold which covers the openings.

Within the context of the invention, the recesses 36 may in particular take the form of blind holes, of notches and/or of grooves formed in the bars 6.

It will be noted that in the case of bars 6 arranged parallel to the longitudinal direction z, the width of the bars is measured parallel to the lateral direction x. In the case of bars 6 arranged parallel to the lateral direction x, the width of the bars is measured parallel to the longitudinal direction z. The closure bars may have a width of between 15 and 40 mm.

The filtering device 31 may be fixed in the passage 10 in various ways. In particular, the filtering device 31 may be joined by brazing to one and/or the other of the plates 2 delimiting the passage 10 in which the filtering device is arranged. The filtering device 31 may also be joined by a thermal-adhesive bond to one and/or the other of the plates 2.

Preferably, a brazing material is arranged between the metal sheet material 30 and at least one plate 2 delimiting the passage 10. The metal sheet material 30 has a melting temperature greater than the melting temperature of the brazing material. The brazing material may in particular be in the form of a coating deposited on at least part of the surfaces of the plates 2.

In particular, the metal sheet material 30 is formed entirely or in part of aluminium or an aluminium alloy, of steel, in particular stainless steel, of nickel or a nickel alloy, in particular an Inconel-type alloy comprising between 50 wt % and 75 wt % nickel. These materials afford the advantage of having good mechanical strength and good durability and readily withstanding cryogenic temperatures. These properties are significant in the context of resistance to the dynamic pressure of the fluid and retention of the load of the catalyst, in particular when the filter is located in the lower part of the heat exchanger.

In particular, a filtering device made entirely or in part of aluminium or an aluminium alloy could be joined by brazing, this material being able to be brazed with the other elements of the heat exchanger which are most frequently made of aluminium or an aluminium alloy. If the filtering device is made entirely or in part of stainless steel, it will preferably be thermally bonded to the plates 2.

The filtering device 31 may have a total width, measured parallel to the longitudinal direction z, of between 2 and 10 mm, preferably between 3 and 7 mm. This affords a good compromise between the need to withstand the tensile force linked to the pressure forces acting in the passages and the pressure loss generated by the filtering device. A width of between 3 and 7 mm is especially suitable at fluid pressures of between 20 and 40 bar.

The filtering device 31 may have a height, measured parallel to the stacking direction y, which is equal to or substantially equal to the height of the closure bars 6 and/or to the height of the distribution and heat-exchange structures 24, 25. The height of the filtering device is defined as being equal to or slightly greater than the height of the passage 10, such that the filtering device is in contact with the adjacent plates 2. In particular, the height of the filtering device may be 0.05 to 0.2 mm greater than the height of the passage 10.

The filtering device 31 may be shaped in various ways, in particular by stamping in a press or by bending the sheet material 30 forming the filtering device.

Figure 6:
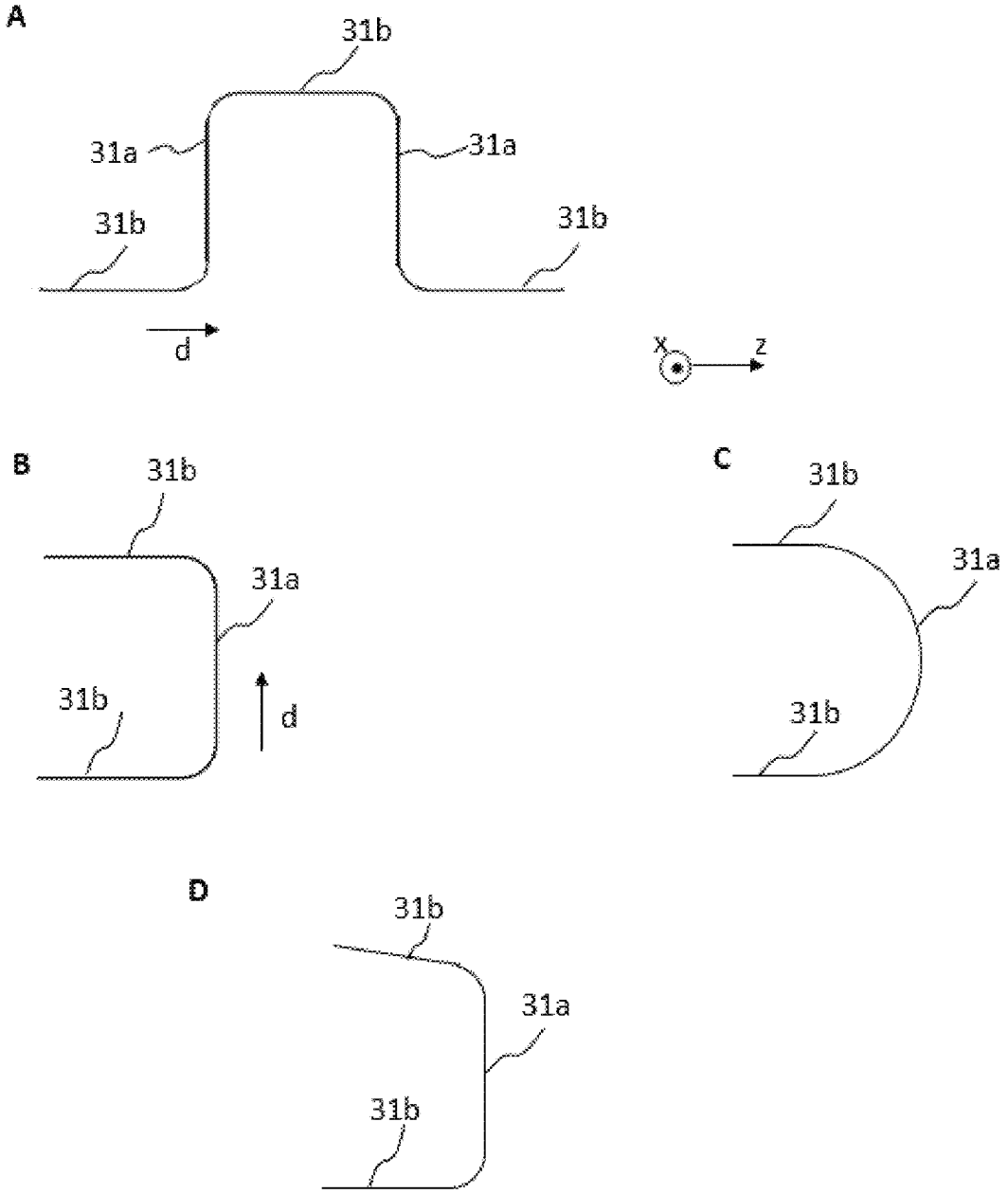
FIG. 6 shows filtering devices according to some embodiments of the invention.

FIG. 6 schematically shows possible shapes of the filtering device 31. In the different embodiments, the filtering device 31 preferably comprises at least one front face 31*a* arranged perpendicularly to the overall flow direction of the first fluid. The front face 31*a* extends parallel to the lateral direction x. It is the front face 31*a* that provides the particle filtration barrier function. It is connected to at least one lateral face 31*b* which is arranged parallel to a plate 2. The lateral face 31*b* serves as a surface for joining the filtering device 31. The lateral face 31*b* may be joined by brazing or by thermal adhesive bonding to the plate 2. The front face 31*a* and the lateral face 31*b* may be connected in a connection zone which may have a larger or smaller radius of curvature depending on the technique used for moulding the filtering device, in particular by stamping or bending.

In an embodiment schematically shown in A in FIG. 6, the filtering device 31 comprises two front faces 31*a* arranged successively in the longitudinal direction z and three lateral faces 31*b*, one of which is intended to be arranged against one of the plates 2 forming the passage 10 and the other two of which are intended to be arranged against the other of the plates 2 forming the passage 10.

In an embodiment schematically shown in B in FIG. 6, the filtering device 31 comprises a front face 31*a* and two lateral faces 31*b* each intended to be arranged parallel to an adjacent plate 2. The lateral faces 31*b* may extend to the left or to the right of the front face 31*a*. The filtering device has a transverse profile in the shape of a U. It will be noted that the branches of the U-shaped profile may extend either in the flow direction of the fluid or counter to it. It will be noted that the front face 31*a* may have a flat surface, as schematically shown in A or B, or a curved surface, in particular concave surface, as in the example schematically shown in C in FIG. 6.

It will be noted that it is possible for at least one lateral face 31*b* not to be perpendicular to the front face 31*a* but rather to form an angle of between 90° and 94° with the front face 31*a*, as is shown for example in D in FIG. 6. If it is difficult to obtain a constant height over the entire length of the filtering device within the sought-after tolerance range, the upper lateral face 31*b* disposed at an angle slightly greater than 90° with respect to the front face makes it possible to obtain a height such that the upper separating metal sheet, once it has been placed on top, affords a contact surface with the device over its entire length.

Figure 7:
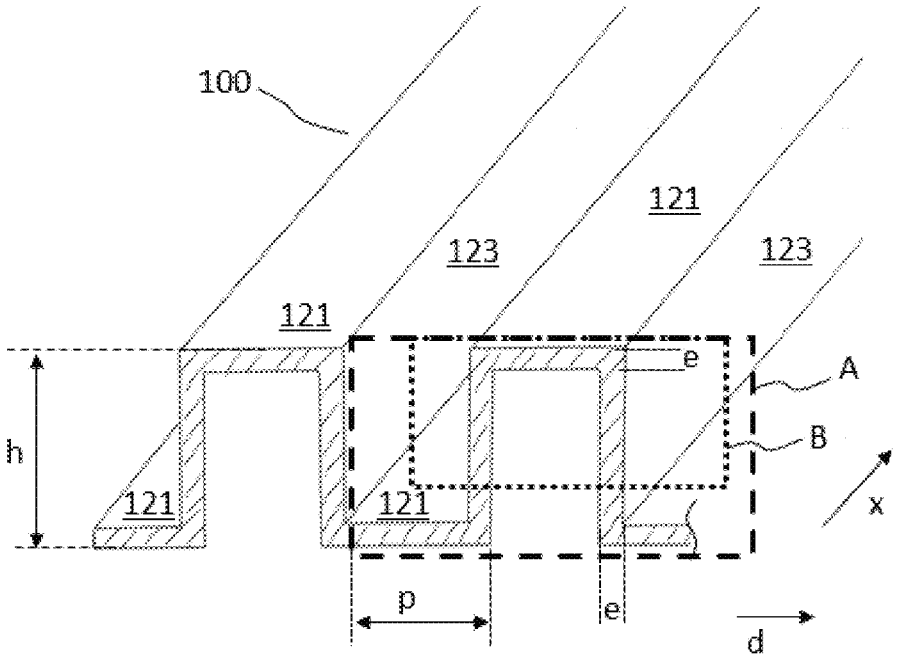
FIG. 7 shows filtering devices according to some embodiments of the invention.

As can be seen in FIG. 7, the filtering device 31 may be formed from a portion of a corrugated product 100 comprising at least two corrugation flanks 123 connected by a corrugation peak 121 which extends perpendicularly to said corrugation flanks 123. The corrugation flanks 123 succeed one another in a direction D1, referred to as corrugation direction, and are arranged periodically at a pitch p. The corrugation flanks 123 and the corrugation peaks 121 have a thickness e which is preferably between 0.2 and 0.75 mm.

Forming the filtering device 31 from a corrugated product 100 makes it possible to combine the items of equipment for manufacturing the heat exchanger, in particular to use the same pressing tools to form the filtering device as those used to form the distribution or heat-exchange structures that are inserted into the passages. Multiple filtering devices may be cut out in one and the same corrugated product 100. The corrugated product 100 may for example be of the same type as that used to form the distribution structure 24 and/or the heat-exchange structure 25, in particular have the same transverse profile, the same pitch between the corrugation flanks, the same height. Preferably, the corrugated product 100 will be of the straight corrugation type, but other corrugation shapes are conceivable.

According to one possibility, the filtering device 31 comprises at least two front faces 31*a* each formed by a corrugation flank 123 of the corrugated product 100 and at least one lateral face 31*b* formed by a corrugation peak 121 of the corrugated product 100. In particular, the filtering device 31 may comprise two front faces 31*a* and three lateral faces 31*b*, one formed by an upper corrugation peak 121 connecting the upper ends of the corrugation flanks 123 and the other two lateral faces 31*b* formed by two lower corrugation peaks 121 each connected to the lower ends of the corrugation flanks 123. This filtering device 31 may be formed by a cutout of a corrugated product 100, as is schematically shown by dashed lines in FIG. 7 and as makes it possible to obtain a filtering device of the type A in FIG. 6. The cutout may for example be made at a lower corrugation peak 121 or at the connection surface connecting a lower corrugation peak 121 to the adjacent corrugation flank 123.

According to another possibility, the filtering device 31 comprises a front face 31*a* formed by a corrugation peak 121 of the corrugated product 100 and two lateral faces 31*b* each formed by a corrugation flank 123 of the corrugated product 100. This filtering device 31 may be formed by a cutout of a corrugated product 100, as is schematically shown by dotted lines in FIG. 7 and as makes it possible to obtain a filtering device of the type B in FIG. 6. The cutout may for example be made at each corrugation flank 123 or at the connection surfaces connecting each corrugation flank 123 to an adjacent lower corrugation peak 121. The filtering device 31 may be arranged in the passage 10 with the corrugation direction D1 perpendicular (illustrated in B) or parallel (not illustrated) to the longitudinal direction z.

According to one possibility, which is not shown in detail, at least one recess 36 is formed by a recess made in a bar 6 over the entire height of the bar, the height being measured in the stacking direction y of the plates 2. The recess 36 has a maximum width $I_{max}$, measured parallel to the longitudinal direction z, which is equal to or substantially equal to, preferably slightly greater than, the total width of the filtering device 31. The recess 36 is produced by removing material over a predetermined depth, measured in the lateral direction x, over the maximum width $I_{max}$ and over a height $h_{max}$ corresponding to the height of the bar 6. The recess thus has, in a plane of section parallel to the plates 2, a transverse profile with an identical or virtually identical shape, in particular a square or rectangular shape, from the face 6*c* of the bar 6 facing the passage 10 to the base of the recess.

Figure 8:
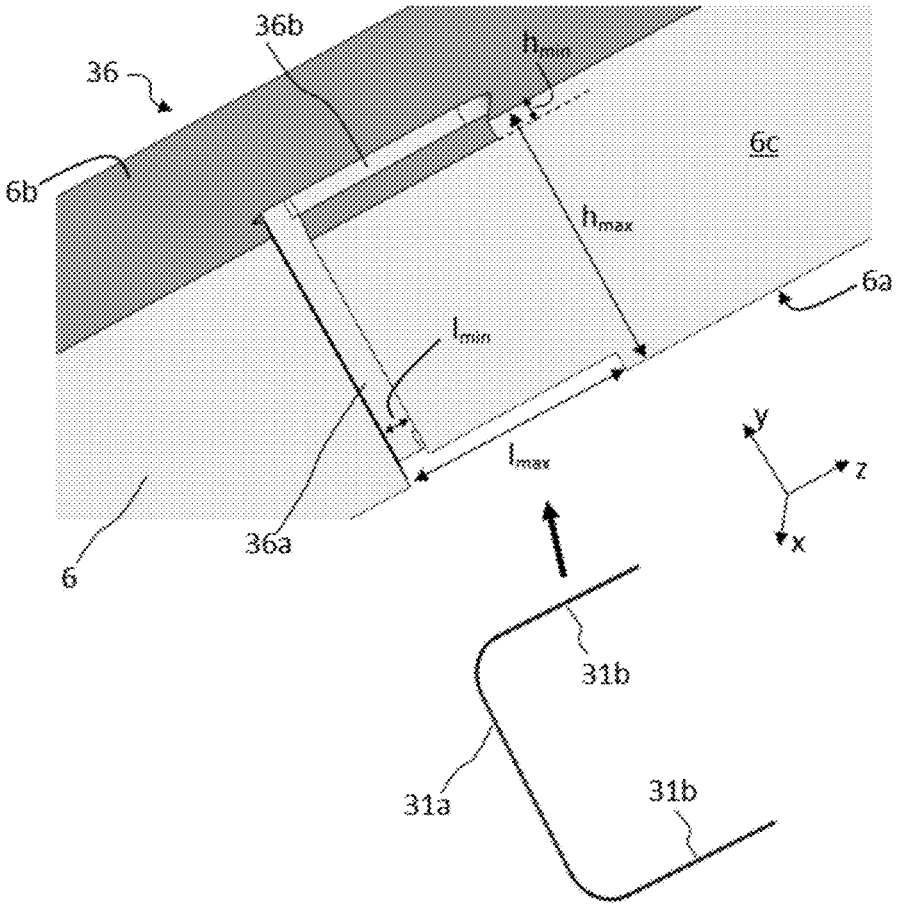
FIG. 8 shows a partial three-dimensional view of a recess according to one embodiment of the invention.
Figure 9:
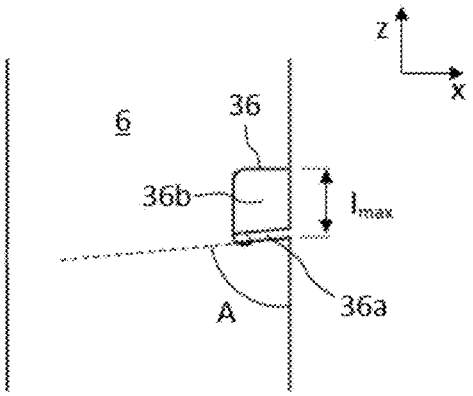
FIG. 9 shows a partial view in longitudinal section of a recess according to one embodiment of the invention.

According to another possibility, illustrated in FIG. 8 and FIG. 9, at least one recess 36 comprises a first portion 36*a* formed over the entire height of the bar 6 and over a minimum width $I_{min}$ less than the maximum width $I_{max}$ of the orifice. The minimum width $I_{min}$, measured parallel to the longitudinal direction z, is preferably equal to or substantially equal to, preferably slightly greater than, the thickness of the sheet material forming the filtering device 31. In particular, the first portion 36*a* forms a groove shaped so as to receive the front face 31*a* of a filtering device 31 at its end 32.

The recess 36 moreover comprises at least one second portion 36*b* made over only part $h_{min}$ of the height of the bar 6 and extending over the maximum width $I_{max}$ of the recess. Preferably, the height $h_{min}$, measured parallel to the stacking direction y, is equal to or substantially equal to, preferably slightly greater than, the thickness of the sheet material forming the filtering device 31. In particular, the second portion 36*b* is suitable for receiving a lateral face 31*b* of a filtering device 31 at its end 32. This embodiment allows good retention of the filtering device in the recess 36. Preferably, the recess 36 comprises two second portions 36*b* which are formed at each surface 6*a*, 6*b* and are parallel to the plates 2 of the bar 6. The recess 36 is thus shaped to receive the end 32 of a filtering device having a front face 31*a* and two lateral faces 31*b*.

It will be noted that the first portion 36*a* and the second portion 36*b* of the recess are produced over a predetermined depth in the lateral direction x. The recess has, in a plane of section parallel to the plates 2, transverse profiles with different dimensions depending on whether they are viewed at the first portion or at the second portion. The transverse profiles of the first portion and/or of the second portion may have a square or rectangular shape.

It will be noted that the first portion 36*a* may extend, in a plane of section parallel to the plates 2, perpendicularly to the longitudinal direction z or form an angle A of between 88° and 82° with respect to the longitudinal direction z. The presence of an angle makes it possible to bring about a slight deformation of the end 32 of the filtering device 31 when it is inserted into the recess 36, thereby locking it in position.

The recesses 36 have a width $I_{max}$, measured parallel to the longitudinal direction z, which is equal to or substantially equal to, preferably slightly less than, the width of the filtering device 31. The recesses 36 may have a predetermined depth, measured parallel to the lateral direction x, of between 10% and 20% of the width of the bars 6. In particular, the recesses 36 have a depth of between 2 and 7 mm, preferably between 4 and 6 mm, ideally approximately 5 mm. These dimensions afford a good compromise between ease of machining of the bars, embedding of the filtering device and reduction in width of the bars. Preferably, the length of the filtering device, measured in the lateral direction x, is between the width of the passage and the width of the passage plus twice the depth of a recess.

The width and the depth of the recesses 36 is defined in particular so as to ensure tightness with respect to the catalyst particles, taking into consideration their size and shape such that they cannot progress into the residual spaces formed between the filtering device and the bars 6. Preferably, there is a second clearance, corresponding to the difference between the width of the filtering device 31 and the width of a recess, that is less than 0.5 mm, in particular less than 0.1 mm. It will be noted that in the case of a recess with multiple portions 36*a*, 36*b*, the widths of the filtering device and of the recess are understood to mean widths measured at the portions in question. Preferably, the second clearance is zero. The depth of the recesses, which corresponds to the length of the ends 32 engaged in the recesses, is defined so as to ensure sufficient retention of the filtering device in the recesses.

The present invention is particularly advantageous when it is implemented in a heat exchanger with brazed fins and plates, because of the simplicity with which it can be implemented and joined. It will be noted, however, that other types of heat exchangers may be used, such as plate heat exchangers, shell and tube heat exchangers, or assemblies of the "core in kettle" type, that is to say plate heat exchangers or plate and fin heat exchangers embedded in a shell in which the refrigerant fluid vaporizes. In the case in which the heat exchangers are tube heat exchangers, the first and second passages may be formed by the spaces in, around and between the tubes.

Preferably, when the metal sheet material is a metal fabric or a microperforated plate, it has an open surface density ranging from 15% to 35%, preferably from 17% to 22%. The open surface density, i.e. the permeability of the fabric or plate, is defined as the ratio of the area of the openings or perforations to the total area of the fabric or microperforated plate, respectively. These ranges of values afford a good compromise between the stiffness of the material, which gives it good mechanical strength, and permeability to the fluid in order to minimize the pressure losses.

In the case of metal sheet materials other than a metal fabric or a microperforated plate, these preferably have a volume density of pores, i.e. a porosity, of at least 75%, more preferably more than 90%, and advantageously less than or equal to 98%. These ranges of values make it possible to retain the fine solid particles while still affording good mechanical strength and a low pressure loss for the fluid. It will be noted that the volume density of pores is defined as the ratio between the volume of the gaps in the material and the total volume of the material. It will be noted that the gaps are understood to mean open pores, that is to say fluidically communicating with the outside environment in which the material is located.

According to a preferred embodiment of the invention, the metal sheet material 30 is a metal fabric formed by metal threads 301, 302. More specifically, the material comprises an interlacing of at least one series of first metal threads 301 with a series of second metal threads 302 so as to form open meshes 33. Depending on the method used for weaving the threads, the meshes may have a square, rectangular or triangular shape. The first metal threads 301 and second metal threads 302 may, but do not necessarily, have identical features, i.e. material, diameter, etc.

Figure 10:
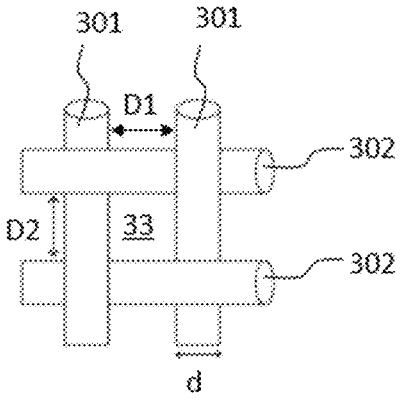
FIG. 10 schematically shows the structure of a filtering device according to another embodiment of the invention.

FIG. 10 schematically shows an exemplary weave in which the first threads and second threads intersect alternately one below and one above. Other weaves are possible, for example threads intersecting alternately two below and two above, one below and two above, etc.

It will be recalled that the features listed in the present application for a fabric also apply when the threads are joined by welding.

The use of a metal fabric allows exact and reproducible control of the features of the filter, by virtue of the geometry of the meshes which is perfectly controlled during the weaving operation. The regularity of the meshes affords a degree of permeability of the filter which is homogeneous over its entire surface; this avoids adversely affecting the performance of the heat exchanger, by virtue of a homogeneous distribution of the flow of fluid through the filter. In addition, the metal fabric makes it possible to obtain an open surface density, defined by the meshes, for blocking the particles in question in an optimum manner and limiting the pressure losses for the fluid passing through them. It also affords good planarity properties, this making it possible to attach the fabric between the closure bars the without too much deformation, in particular when the fabric is arranged in a recess in the closure bar.

Preferably, said threads 301, 302 have a diameter d ranging from 0.10 to 0.30 mm, in particular from 0.10 to 0.25 mm, thereby making it possible to confer good mechanical strength on the fabric by way of the tensile strength of its threads. Further preferably, said threads may have a diameter ranging from 0.12 to 0.18 mm.

Each mesh 33 is delimited between two consecutive first threads 301 and two consecutive second threads 302, the meshes preferably having an opening size from 0.07 mm to 0.15 mm. The dimensioning of the opening size of the meshes is defined so as to retain the larger solid particles which should be stopped.

In the case of square or rectangular meshes, as shown in FIG. 10, the mesh opening size is defined as the distance D1 between two consecutive first threads 301 and/or the distance D2 between two consecutive second threads 302. In the case of triangular meshes (not illustrated), the mesh opening size is defined as the diameter of the tangent sphere inserted in the mesh.

Preferably, the metal sheet material 30 has a thickness ranging from 0.2 to 0.75 mm. This thickness gives the material sufficient mechanical strength. For a metal fabric, the thickness results from the diameter of the threads and the way in which the meshes created are joined.

According to one possibility, the metal sheet material is a sintered metal powder or sintered metal fibres. In particular, use may be made of stainless steel or bronze powders which are bonded by atomic diffusion at a temperature lower than the melting temperature of the material.

According to another possibility, the metal sheet material is a microperforated plate with a plurality of preferably circular orifices having a diameter which is advantageously between 0.07 mm and 0.15 mm. Preferably, the plate has a thickness of between 0.2 mm and 0.5 mm. Preferably, the orifices are uniformly distributed over the microperforated plate.

According to another possibility, the metal sheet material is a foam formed by a metal material. Preferably, the metal foam has a volume density of pores of at least 75%, more preferably greater than 90%, so as to allow the fluid to pass with manageable pressure losses. Preferably, the pores of the metal foam have a size of between 0.04 and 0.15 mm. Preferably, the size of the pores is understood to mean their equivalent diameter. The term "equivalent diameter" of a nonspherical pore is understood to mean the diameter of the sphere of the same volume as said pore.

The present invention is particularly advantageous if the heat exchanger is an exchanger-reactor, i.e. catalytic heat exchanger, which is configured to implement catalytic reactions between the first fluid F1 and at least one catalyst material, the passages of the first series containing said at least one catalyst material in the form of particles. In particular, the heat exchanger is configured for the cooling, or even the liquefaction, of at least some of the hydrogen as first fluid F1, the catalyst material being configured for the conversion of ortho-hydrogen into para-hydrogen, in particular the catalyst material is a catalyst comprising a metal oxide, preferably iron oxide ($Fe_2O_3$). During operation, the hydrogen is introduced in the gaseous state through the first inlet manifold 21 and flows in the first passages 10 so as to be cooled there against a stream of liquid nitrogen flowing in the second passages 20. At least some of the molecules of the flow of gaseous hydrogen are converted from ortho-hydrogen to para-hydrogen by means of the catalyst material. The hydrogen is evacuated in the cold state, or even entirely or partially liquefied state, through the first outlet manifold 22.

Preferably, the catalyst material comprises particles having an equivalent diameter ranging from a minimum particle diameter to a maximum particle diameter. Preferably, the minimum diameter is between 0.2 and 0.4 mm. Preferably, the maximum diameter is between 0.5 and 0.7 mm. Further preferably, the particles of the catalyst material have an equivalent diameter ranging from 0.2 to 0.7 mm.

Preferably, the metal sheet material 30 is a woven fabric of metal threads having a mesh opening size constituting between 30% and 70% of the minimum particle diameter. These ratios are defined so as to stop the very fine particles or dust resulting from the abrasion of catalyst particles during the filling or during operation, while still affording a satisfactory compromise in terms of pressure losses.

The term "equivalent diameter" of a nonspherical particle is understood to mean, in the present application, the diameter of the sphere of the same volume as said particle.

The invention also relates to a method for assembling a catalytic heat exchanger, which can be implemented in a simpler and better controlled manner by virtue of the invention. A filtering device 31 is arranged in all or some of the passages 10 on the side of the outlet surface 12. The body 1 is brazed in order to bond the elements constituting the heat exchanger together, such as plates, bars, heat-exchange structures, distribution structures if appropriate. The brazed stack is positioned vertically and the outlet manifold 22 is joined below the body in the ascending, vertical direction z. The passages 10 are then filled with the catalyst. The filtering devices 31 positioned in the lower part of the body retain the catalyst. The filling can possibly be carried out by means of a tray, which may be rectangular, positioned over the heat-exchange body 1 so as to face the openings of passages to be filled. The tray is removed once the filling is completed. The first inlet manifold 21 is joined.

Moreover, the heat exchanger may comprise a filtering device 31 arranged on the side of the inlet surface 11. A filtering device 31 is arranged in all or some of the passages 10 on the side of the inlet surface 11. The body 1 is brazed and then the first inlet manifold 21 is joined to the body 1.

It will be noted that, within the context of the invention, the filtering device(s) is/are preferably joined to the body 1 before it is brazed. Preferably, the manifolds are joined to the brazed body 1 by welding.

This assembly method is particularly suitable for heat exchangers having passages that need to be filled with catalyst particles. The passages are filled with the catalyst particles after the heat-exchange body, equipped with the filtering device and the outlet manifold, has been positioned vertically, this making it possible to fill in the catalyst under the effect of gravity and to better control the distribution of the catalyst between the various passages.

It will be noted that, for a heat exchanger in which the intrusion of dust from the upstream fluid circuit is to be avoided, the arrangement of a filtering device on the side where the outlet manifold of the heat exchanger is optional. It will moreover be noted that other filtering devices according to the invention may also be arranged so as to provide one or more of the functions described in the present application for the second passages 20.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A heat exchanger comprising a stack of multiple plates which are parallel to one another and to a longitudinal direction, said plates being stacked spaced apart from one another so as to define, between one another, a first series of passages for the flow of at least a first fluid in an overall flow direction parallel to the longitudinal direction, each passage being delimited by closure bars disposed between the plates, wherein a filtering device is arranged in at least one passage of the first series, said filtering device extending for the one part between two adjacent plates defining said passage and for the other part between two of the closure bars delimiting said passage, said filtering device comprising a metal sheet material selected from the group consisting of a metal fabric, a nonwoven of metal fibres, a sintered metal powder or sintered metal fibres, a metal foam, and a microperforated plate.

2. The heat exchanger according to claim 1, further comprising at least a first inlet or outlet manifold configured for introducing the first fluid into or collecting the first fluid from the first passages, a distribution structure and a heat-exchange structure being arranged consecutively from the first inlet or outlet manifold in said at least one passage, the filtering device being arranged between the distribution structure and the heat-exchange structure.

3. The heat exchanger according to claim 1, further comprising at least a first inlet or outlet manifold configured for introducing the first fluid into or collecting the first fluid from the first passages, a distribution structure and a heat-exchange structure being arranged consecutively from the first inlet or outlet manifold in said at least one passage, the filtering device being arranged between the distribution structure and the first inlet or outlet manifold.

4. The heat exchanger according to claim 1, wherein the filtering device comprises two ends, each of which is arranged in a respective recess in a closure bar.

5. The heat exchanger according to claim 1, wherein the filtering device comprises at least one front face arranged perpendicularly to the overall flow direction of the first fluid, said front face being connected to at least one lateral face arranged parallel to a plate.

6. The heat exchanger according to claim 1, wherein the filtering device has a total width, measured parallel to the longitudinal direction, of between 2 and 10 mm.

7. The heat exchanger according to claim 1, wherein the metal sheet material has a thickness of 0.20 to 0.75 mm.

8. The heat exchanger according to claim 1, wherein the metal sheet material has an open surface density ranging from 15% to 35% or a volume density of pores ranging from 75% to 98%.

9. The heat exchanger according to claim 1, wherein the metal sheet material is a woven fabric of metal threads, said threads having a diameter of 0.10 to 0.30 mm.

10. The heat exchanger according to claim 1, wherein the metal sheet material comprises at least one series of first metal threads and a series of second threads interlaced so as to form meshes, each mesh being delimited between two consecutive first threads and two consecutive second threads, the meshes having an opening size of 0.07 mm to 0.15 mm.

11. The heat exchanger according to claim 1, wherein the metal sheet material is a microperforated plate having a plurality of orifices the size of which, measured in a plane parallel to the plates, is at most between 0.07 mm and 0.15 mm.

12. The heat exchanger according to claim 1, wherein the heat exchanger is an exchanger-reactor configured to implement catalytic reactions between the first fluid and at least one catalyst material, at least some of the passages of the first series containing particles of said at least one catalyst material.

13. The heat exchanger according to claim 12, wherein the catalyst material comprises particles having an equivalent diameter ranging from a minimum diameter to a maximum diameter, the metal sheet material being a woven fabric of metal threads with a mesh opening size ranging from 10% to 85% of said minimum diameter of the particles.

14. The heat exchanger according to claim 12, configured for the liquefaction of hydrogen as first fluid, the catalyst material being configured for the conversion of ortho-hydrogen to para-hydrogen.

* * * * *